US010811161B2

(12) United States Patent
Masquelier et al.

(10) Patent No.: US 10,811,161 B2
(45) Date of Patent: Oct. 20, 2020

(54) ALUMINIUM-ALUMINA COMPOSITE MATERIAL AND ITS METHOD OF PREPARATION

(71) Applicant: NEXANS, Courbevoie (FR)

(72) Inventors: Nicolas Masquelier, Montréal (CA); Rodrigue Sumera, Epinoy (FR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/467,785

(22) PCT Filed: Dec. 5, 2017

(86) PCT No.: PCT/FR2017/053400
§ 371 (c)(1),
(2) Date: Jun. 7, 2019

(87) PCT Pub. No.: WO2018/109316
PCT Pub. Date: Jun. 21, 2018

(65) Prior Publication Data

US 2019/0304618 A1 Oct. 3, 2019

(30) Foreign Application Priority Data

Dec. 13, 2016 (FR) ..... 16 62371

(51) Int. Cl.

| | |
|---|---|
| ***H01B 1/02*** | (2006.01) |
| ***B21C 1/00*** | (2006.01) |
| ***B22D 11/00*** | (2006.01) |
| ***C22C 1/10*** | (2006.01) |
| ***C22C 49/06*** | (2006.01) |
| ***H01B 13/00*** | (2006.01) |
| ***B21C 23/00*** | (2006.01) |
| ***B21C 37/04*** | (2006.01) |

(52) U.S. Cl.
CPC ..... *H01B 1/023* (2013.01); *B21C 1/003* (2013.01); *B21C 23/002* (2013.01); *B21C 37/045* (2013.01); *B22D 11/003* (2013.01); *B22D 11/005* (2013.01); *C22C 1/1084* (2013.01); *C22C 49/06* (2013.01); *H01B 13/0036* (2013.01); *B22F 2998/10* (2013.01)

(58) Field of Classification Search
CPC ..... C22C 1/1084; C22C 47/04; C22C 47/08; C22C 49/06; B21C 1/003; B21C 23/002; B21C 37/045; B22D 11/003; B22D 11/005; H01B 13/0036; H01B 1/023
See application file for complete search history.

(56) References Cited

U.S. PATENT DOCUMENTS

| | | | | |
|---|---|---|---|---|
| 3,740,210 | A | 6/1973 | Bomford et al. | |
| 3,982,906 | A * | 9/1976 | Hirai | B22F 3/24 419/19 |
| 5,246,057 | A | 9/1993 | Hansson et al. | |
| 6,544,645 | B1 | 4/2003 | McCullough et al. | |

(Continued)

OTHER PUBLICATIONS

International Search Report dated Jan. 24, 2018.

*Primary Examiner* — William H. Mayo, III
*Assistant Examiner* — Rhadames Alonzo Miller
(74) *Attorney, Agent, or Firm* — Sofer & Haroun, LLP

(57) ABSTRACT

The present invention relates to a composite material based on aluminium and alumina, its method of manufacture, and a cable comprising said composite material as an electrical conductor element.

17 Claims, 3 Drawing Sheets

(56) References Cited

U.S. PATENT DOCUMENTS

| | | | | |
|---|---|---|---|---|
| 2002/0107133 | A1* | 8/2002 | Troczynski | C04B 28/34 501/1 |
| 2006/0115597 | A1* | 6/2006 | Beauvy | B82Y 30/00 427/289 |
| 2015/0147624 | A1* | 5/2015 | Yamafuku | H01G 11/26 429/121 |
| 2015/0279518 | A1* | 10/2015 | Comoret | C25D 11/04 174/70 A |
| 2016/0273081 | A1 | 9/2016 | Tarrant et al. | |
| 2016/0290098 | A1* | 10/2016 | Marya | E21B 43/26 |
| 2017/0233579 | A1* | 8/2017 | Yushin | C01B 13/18 427/212 |
| 2017/0251550 | A1* | 8/2017 | Su | B32B 7/12 |
| 2019/0207187 | A1* | 7/2019 | Huang | H01M 2/145 |

* cited by examiner

ALUMINIUM-ALUMINA COMPOSITE MATERIAL AND ITS METHOD OF PREPARATION

RELATED APPLICATION

This application is a National Phase of PCT/FR2017/053400 filed on Dec. 5, 2017, which claims the benefit of priority from French Patent Application No. 16 62371, filed on Dec. 13, 2016, the entirety of which are incorporated by reference.

FIELD OF THE INVENTION

The present invention relates to a composite material based on aluminium and alumina, its method of manufacture, and a cable comprising said composite material as an electrical conductor element.

It applies typically but not exclusively to low-voltage power cables (particularly below 6 kV) or medium-voltage power cables (especially those from 6 to 45-60 kV) or high-voltage power cables (especially those over 60 kV, and possibly up to 800 kV), whether of direct or alternating current, in the fields of overhead, submarine, and terrestrial electricity transmission and aeronautics.

More particularly, the invention relates to an electrical cable having good mechanical properties, especially in terms of mechanical tensile strength, and good electrical properties, especially in terms of electrical conductivity.

DESCRIPTION OF THE RELATED ART

It is known practice to replace conductors made of copper or copper alloy with conductors made of aluminium or aluminium alloy. Even though aluminium is lighter and more economical than copper, this metal has poor mechanical properties, especially in terms of mechanical tensile strength, making it hard to use in the field of cables.

In order to improve the mechanical properties of a conductor made of aluminium or aluminium alloy, U.S. Pat. No. 6,245,425 has described a method of preparation of a composite aluminium-alumina material, especially in the form of a continuous wire, comprising a step of impregnation of a fibrous material composed of polycrystalline fibres of alumina ($\alpha$-$Al_2O_3$) with molten aluminium and a step during which the fibrous material impregnated and coated with molten aluminium is solidified. In particular, the impregnation is performed continuously with an appropriate device emitting ultrasound or with the aid of a mould under high pressure. The composite material obtained comprises around 30 to 70% by volume of alumina fibres and has a mechanical tensile strength greater than or equal to 1.38 GPa. However, said composite material has a very low electrical conductivity (e.g. around 30% IACS) which is ill suited for an application in the field of cables, and too high a mechanical strength to be easily manipulated. Furthermore, the method making it possible to obtain said material uses costly raw materials.

Objects and Summary:

Thus, the purpose of the present invention is to provide a composite material based on aluminium having an improved electrical conductivity and an optimized mechanical strength so that it can be easily manipulated for use in the field of cables, especially as an electrical conductor element of a power and/or telecommunications cable. Another purpose of the invention is to provide a simple and economical method for preparation of such a composite material.

Thus, the invention has as its first object a composite material comprising a matrix of aluminium or aluminium alloy and particles of alumina dispersed in said matrix of aluminium or aluminium alloy.

The composite material of the invention has an improved electrical conductivity and an optimized mechanical strength so that it can be easily manipulated, especially for a use in the field of cables, particularly as an electrical conductor element of a power and/or telecommunications cable.

The composite material preferably comprises around 1 to around 10,000 ppm of alumina, and preferably around 100 to around 5000 ppm of alumina.

In the present invention, the expression "ppm" means "parts per million" and relates to a mass fraction.

The composite material preferably has an electrical conductivity of at least around 45% IACS (International Annealed Copper Standard), more preferably at least 50% IACS, and even more preferably at least around 55% IACS.

The composite material preferably has a mechanical tensile strength ranging from around 70 to around 500 MPa, and more preferably around 130 to around 400 MPa.

The composite material preferably comprises particles of alumina uniformly dispersed in a matrix of aluminium or aluminium alloy.

The particles of alumina of the composite material preferably have an irregular and/or random shape.

In one particular embodiment, the particles of alumina are in the form of needles or plaques or they contain particles of alumina in the form of needles or plaques.

According to one preferred embodiment, the particles of alumina are not spherical.

The particles of alumina preferably have a thickness (the thickness being defined as the smallest dimension of each of said particles) of at least around 0.1 μm, and preferably of at least around 0.5 μm.

According to one embodiment of the invention, the particles of alumina have a mean size from around 0.1 to around 50 μm, preferably around 0.1 to around 10 μm, more preferably around 0.5 to around 10 μm, and more preferably around 1 to around 10 μm.

The mean size of the particles of alumina is measured by scanning electron microscopy (SEM).

According to one embodiment of the invention, the composite material has a porosity of at most around 1% by volume, and preferably it is nonporous.

The aluminium content of the aluminium alloy of the matrix may be at least 80% by weight, and preferably at least 95% by weight, in relation to the total weight of the aluminium alloy.

The aluminium alloy may be chosen from among the aluminium alloys of series 1000 (i.e. 99% aluminium minimum), 5000 (i.e. containing at least magnesium), 6000 (i.e. containing at least magnesium and silicon) and 8000 (i.e. containing less than 99% aluminium).

The aluminium alloy may further comprise one or more inevitable impurities.

As examples of aluminium alloys able to be used in the composite material of the invention, mention may be made of the alloys Al1120, Al1370 Al6101, Al6201, Al8030, Al8076 and the thermal alloys.

Preferably, the composite material does not comprise fibres of alumina. In this way, the composite material is not too rigid and it can be easily manipulated, especially for a use in the field of cables.

Preferably, the composite material of the invention is free of organic polymer(s). In fact, the presence of organic polymers may degrade its electrical properties, especially its electrical conductivity.

The composite material is preferably constituted solely of the matrix of aluminium or aluminium alloy and particles of alumina dispersed in said matrix of aluminium or aluminium alloy.

The composite material of the invention is preferably in the form of a solid mass.

In other words, it is preferably not in powdery form.

Thus, the invention has as its second object a method for preparation of a composite material comprising a matrix of aluminium or aluminium alloy and particles of alumina dispersed in said matrix of aluminium or aluminium alloy, characterized in that it comprises at least the following steps:

i) placing in contact at least one elongated electrical conductor element of aluminium or of aluminium alloy comprising a layer of hydrated alumina with molten aluminium or a molten aluminium alloy, ii) forming a solid mass based on alumina and aluminium, and iii) breaking the layer of hydrated alumina inside the solid mass, in order to form a composite material comprising a matrix of aluminium or aluminium alloy and particles of alumina dispersed in said matrix of aluminium or aluminium alloy.

Thanks to the method of liquid metallurgy of the invention, a composite material comprising particles of alumina dispersed in a matrix of aluminium or aluminium alloy can be easily formed, while still having good mechanical properties, especially in terms of mechanical tensile strength, and electrical conductivity, in particular thanks to the homogeneous dispersion of the particles of alumina in the matrix of aluminium or aluminium alloy. Furthermore, it makes it possible to avoid any manipulation of metal oxide and/or metal powder. The method is simple, easy to carry out, and economical.

The elongated electrical conductor element or elements used in step i) generally have a diameter ranging from around 1 to around 20 mm.

The elongated electrical conductor element or elements used in step i) are in the form of a solid mass or masses.

The elongated electrical conductor element or elements used in step i) are generally anodized machine wires.

In the invention, the layer of hydrated alumina is a layer of alumina hydroxide or of aluminium oxide hydroxide.

The layer of hydrated alumina may be a monolayer of hydrated alumina or a polylayer of hydrated alumina, such as a trilayer of hydrated alumina.

As an example of a monolayer of hydrated alumina, mention may be made of a layer of boehmite, which is the gamma polymorph of AlO(OH) or $Al_2O_3.H_2O$; or diaspore, which is the alpha polymorph of AlO(OH) or $Al_2O_3.H_2O$.

As an example of a trilayer of hydrated alumina, mention may be made of a layer of gibbsite or hydrargillite, which is the gamma polymorph of $Al(OH)_3$; a layer of bayerite, which is the alpha polymorph of $Al(OH)_3$; or a layer of nordstrandite, which is the beta polymorph of $Al(OH)_3$.

Preferably, the layer of hydrated alumina is directly in physical contact with the elongated electrical conductor element of aluminium or aluminium alloy. In other words, there are no intercalated layers between the layer of hydrated alumina and said elongated electrical conductor element of aluminium or aluminium alloy.

The layer of hydrated alumina may have a thickness ranging from around 1 to around 50 μm, and preferably around 4 to around 20 μm.

In one particular embodiment, the molten aluminium or molten aluminium alloy of step i) is brought to a temperature ranging from around 660° C. to around 900° C., and preferably around 660° C. to around 760° C.

Step i) may be carried out according to any one of the following methods:

casting molten aluminium or a molten aluminium alloy onto said elongated electrical conductor element of aluminium or of aluminium alloy comprising a layer of hydrated alumina, or passing said elongated electrical conductor element of aluminium or of aluminium alloy comprising a layer of hydrated alumina continuously through a bath of molten aluminium or of a molten aluminium alloy (a method also known as "dip forming").

At the end of step i), the elongated electrical conductor element of aluminium or aluminium alloy comprising a layer of hydrated alumina is coated with at least one layer of molten aluminium or of a molten aluminium alloy, surrounding the layer of hydrated alumina.

Step i) carried out by casting of molten aluminium or a molten aluminium alloy on said elongated electrical conductor element may comprise the following sub-steps (non-continuous process):

i-a) placing at least one elongated electrical conductor element of aluminium or aluminium alloy comprising a layer of hydrated alumina into a container, and i-b) casting molten aluminium or a molten aluminium alloy into said container.

The container may be a mould, and in particular a cylindrical mould.

Step i) carried out by noncontinuous casting is particularly appropriate when several elongated electrical conductor elements of aluminium or of aluminium alloy comprising a layer of hydrated alumina are used. They are then placed for example in a container as is defined in the invention, then the molten aluminium or aluminium alloy is cast onto all the elongated electrical conductor elements contained in said container.

Step i) carried out by casting of molten aluminium or a molten aluminium alloy onto said elongated electrical conductor element may comprise the following sub-steps (continuous process):

i-a') placing at least one elongated electrical conductor element of aluminium or of aluminium alloy comprising a layer of hydrated alumina on a casting wheel, and i-b') casting molten aluminium or a molten aluminium alloy onto the casting wheel.

Step i) carried out by continuous passing of said elongated electrical conductor element through a bath of molten aluminium or of a molten aluminium alloy may comprise the following sub-steps:

i-A) placing at least one elongated electrical conductor element of aluminium or of aluminium alloy comprising a layer of hydrated alumina into a device comprising at least one vat designed to contain a bath of molten aluminium or of a molten aluminium alloy and transport means serving to convey said elongated electrical conductor element towards said vat, and i-B) continuously passing said at least one elongated electrical conductor element through said bath of molten aluminium or of a molten aluminium alloy.

Step i) carried out by dip forming may be implemented with one or more elongated electrical conductor elements of aluminium or of aluminium alloy comprising a layer of hydrated alumina.

Step ii) is a solidification step.

Step ii) is generally carried out in air, especially at around 20° C.

The solid mass obtained at the end of step ii) may be of monobloc type, such as a massive cylinder or bar for example.

When step i) is carried out by noncontinuous casting, step ii) may consist in removing from the container said at least one elongated electrical conductor element of aluminium or of aluminium alloy comprising a layer of hydrated alumina and coated with molten aluminium or a molten aluminium alloy obtained at the end of step i), then cooling it to obtain a solid mass.

When step i) is carried out by continuous casting (i.e. with a casting wheel), step ii) may consist in cooling said at least one elongated electrical conductor element of aluminium or of aluminium alloy comprising a layer of hydrated alumina and coated with molten aluminium or a molten aluminium alloy obtained at the end of step i), directly at the exit from the casting wheel, especially with the aid of cooling means, to obtain a solid mass.

The cooling may also take place later on in a rolling mill, in particular in the presence of water and possibly lubricants.

When step i) is carried out by dip forming, step ii) may consist in cooling said at least one elongated electrical conductor element of aluminium or of aluminium alloy comprising a layer of hydrated alumina and coated with molten aluminium or a molten aluminium alloy obtained at the end of step i), directly at the exit from the vat, especially with the aid of cooling means contained in the device as defined above, to obtain a solid mass.

The cooling may also take place later on in a rolling mill, in particular in the presence of water and possibly lubricants.

Step iii) is a step of deformation of the solid mass making it possible to break the layer of hydrated alumina.

In particular, it makes it possible to break or explode the layer of hydrated alumina and uniformly disperse the particles of alumina in a matrix of aluminium or of an aluminium alloy.

When several electrical conductor elements are used in step i), step iii) makes it possible to break all the layers of hydrated alumina.

Step iii) may be a rolling or extrusion step.

When step iii) is a rolling step, it is generally carried out in the cold state, particularly at a temperature ranging from around 5 to around 40° C., or in the hot state, particularly at a temperature ranging from around 40 to around 600° C.

When the step iii) is an extrusion step, it is generally carried out at a temperature ranging from around 20 to around 650° C.

The extrusion may be direct, indirect or isostatic.

Step iii) of rolling is particularly appropriate when step i) is carried out according to a continuous process, that is, by continuous passing of said at least one elongated electrical conductor element of aluminium or of aluminium alloy comprising a layer of hydrated alumina through a bath of molten aluminium or of a molten aluminium alloy (dip forming) or by continuous casting of molten aluminium or a molten aluminium alloy onto at least one elongated electrical conductor element of aluminium or of aluminium alloy comprising a layer of hydrated alumina placed on a casting wheel.

In this embodiment, steps i), ii) and iii) may then be performed continuously.

In particular, the dip forming device as defined above may further comprise rolling means (e.g. a rolling mill) arranged after the cooling means as defined above.

The solid mass can then be brought up to said rolling means arranged after the cooling means to carry out step iii).

Step iii) of extrusion, especially direct, indirect or isostatic extrusion, is particularly appropriate when step i) is carried out by casting molten aluminium or a molten aluminium alloy onto said at least one elongated electrical conductor element of aluminium or of aluminium alloy comprising a layer of hydrated alumina placed in a container (noncontinuous process).

At the end of step iii), a composite material of diameter ranging from around 2 to around 350 mm can thus be obtained.

At the end of step iii), the composite material is generally of elongated shape.

Thus, the method of the invention makes it possible to form in three steps a composite material comprising a matrix of aluminium or aluminium alloy and particles of alumina uniformly dispersed in said matrix.

The method may further comprise a step iv) of shaping the composite material obtained in the preceding step iii) in order to obtain a composite material having the desired dimensions and shape.

Step iv) may in particular comprise the following step or steps: a step of spinning and/or a step of wire drawing and/or a step of rolling and/or a step of conformal extrusion (i.e. continuous extrusion) of the composite material of step iii).

Step iv) may be carried out at a temperature of at most around 80° C.

When step i) is carried out by dip forming or by continuous casting (i.e. with a casting wheel) and step iii) by rolling, step iv) preferably comprises a step of wire drawing and/or a step of conformal extrusion.

When step i) is carried out by noncontinuous casting and step iii) by extrusion, step iv) preferably comprises a step of rolling and/or wire drawing and/or conformal extrusion.

The method may further involve, after step iii) or step iv), a heating step v).

This step makes it possible in particular to increase the mechanical elongation of the composite material of step iii) or of step iv).

This step is conventionally known as an annealing step. The annealing step makes it possible to increase the mechanical elongation of a metallic element by heating it, and thus to be able to deform it easily once annealed.

In one particular embodiment, step v) is performed at a temperature ranging from around 200° C. to around 500° C.

In one particular embodiment, the duration of step v) varies from around 10 minutes to around 20 hours.

In particular, the heating step v) has the purpose of softening the composite material of step iii) or step iv), that is, of eliminating a portion of the deformation caused in particular by step iii) or iv) (e.g. wire drawing), without modifying the structure of the composite material obtained at the end of step iii).

In one particular embodiment, step v) may result in an elongated electrical conductor element having an elongation at breaking ranging from around 5 to around 50%, and preferably from around 20 to around 40%.

The heating according to step v) may be performed with the aid of an electric furnace (i.e. a resistance furnace) and/or an induction furnace and/or a gas furnace.

According to one embodiment, the method of the invention furthermore comprises, prior to step i), a step $i_0$) of formation of the layer of hydrated alumina.

This step may be carried out by chemical conversion.

In one particularly advantageous embodiment, step $i_0$) of the method is carried out by anodization.

Anodization is a surface treatment making it possible to form by anodic oxidation, starting with an elongated electrical conductor element of aluminium or of aluminium alloy, the layer of hydrated alumina. Thus, the anodization will consume a portion of the elongated electrical conductor element to form said layer of hydrated alumina.

During the anodization, the layer of hydrated alumina is formed from the surface of the elongated electrical conductor element towards the core of said elongated electrical conductor element, unlike an electrolytic deposition.

Anodization is classically based on the principle of electrolysis of water. It consists in submerging the elongated electrical conductor element in an anodization bath, said elongated electrical conductor element being placed at the positive pole of a generator of direct current.

The anodization bath is more particularly an acid bath, preferably a bath of phosphoric acid or a bath of sulfuric acid. Reference is then made respectively to phosphoric anodization or sulfuric anodization.

When the layer of hydrated alumina is formed advantageously by anodization, the electrolytic parameters are imposed by a current density and a conductivity of the bath. For a desired thickness on an elongated electrical conductor element prototype of around 8 to around 10 μm, the current density is preferably set at around 55 to around 65 $A/dm^2$, the voltage is set at around 20 to around 21 V, and the current strength is set at around 280 to around 350 A.

The layer of hydrated alumina formed at the end of the anodization is porous.

The current density applied makes it possible to guarantee a sufficient quantity of pores has been formed.

The method according to the invention may furthermore comprise at least one of the following steps, prior to step $i_0$):

a) degreasing said elongated electrical conductor element, and/or b) scouring said elongated electrical conductor element.

Preferably, step a) and step b) can be performed at the same time.

Furthermore, the method according to the invention may further comprise the following step, prior to step $i_0$):

c) neutralizing said elongated electrical conductor element.

In one particularly preferred embodiment, the method according to the invention may comprise said three steps a), b) and c), step c) being performed after steps a) and b).

The degreasing step a) is meant to eliminate the various bodies and particles contained in the greases liable to be present on the surface of the elongated electrical conductor element.

It may be carried out chemically or assisted by electrolysis.

As an example, degreasing step a) may be performed by dipping at least partly the elongated electrical conductor element into a solution comprising at least one surfactant as degreasing agent.

The scouring step b) serves to eliminate the oxides liable to be present on the surface of the elongated electrical conductor element. There are several methods of scouring: chemical, electrolytic, or mechanical.

Preferably, it will be possible to use a chemical scouring which consists in eliminating the oxides by dissolution, or even by bursting of the oxide layer, without attacking the material of the underlying elongated electrical conductor element.

As an example, the scouring step b) may be performed by dipping at least partly the elongated electrical conductor element into a solution comprising a base as scouring agent.

When step a) and step b) are performed at the same time, a single solution comprising a degreasing agent and a scouring agent may be used for simultaneous scouring and degreasing of the elongated electrical conductor element.

The neutralization step c) makes it possible to condition the elongated electrical conductor element, prior to step $i_0$).

More particularly, when step $i_0$) is an anodization step, the neutralization step c) consists in conditioning the elongated electrical conductor element by dipping it at least partly in a solution identical to the anodization bath provided in step $i_0$), in order to place the surface of the elongated electrical conductor element at the same pH as the anodization bath of step $i_0$).

This solution furthermore allows, on the one hand, eliminating certain traces of oxides able to harm the anodization, and on the other hand eliminating any residues of the scouring agent. The neutralization makes it possible to place the surface of the aluminium at the same pH as the anodic bath.

As an example, the neutralization step c) may be performed by dipping at least partly the elongated electrical conductor element into a solution comprising an acid as the neutralizing agent.

As an example, it is preferable to first of all scour and degrease said elongated electrical conductor element, by dipping it into a solution of soda and surfactants such as the solution known as GARDOCLEAN, marketed by the CHEMETALL company (30-50 g/L of soda), in particular at a temperature ranging from around 40 to around 60° C., for a duration of around 30 seconds. Next, said elongated electrical conductor element can be dipped into a solution of sulfuric acid (20% by weight of sulfuric acid in distilled water) to carry out the neutralization step c), preferably at ambient temperature (i.e. 25° C.), for 10 seconds.

Step $i_0$) may then be performed.

As an example, an elongated electrical conductor element of aluminium alloy, for example with diameter of 3 mm, can be anodized by forming a layer of hydrated alumina all around said elongated electrical conductor element, by sulfuric anodization (20 to 30% by weight of sulfuric acid in distilled water) at a temperature of 30° C., or by phosphoric anodization (8 to 30% by weight of phosphoric acid in distilled water) at ambient temperature (i.e. 25° C.), under the application of a current density comprised between 55 and 65 $A/dm^2$. Said elongated electrical conductor element of aluminium alloy obtained is thus covered with a layer of hydrated alumina.

The layer of hydrated alumina obtained at the end of step $i_0$) may be porous. The pores may be arranged in a substantially regular (or homogeneous) manner all along the external surface of the layer of alumina, and they may all have substantially the same dimensions.

In one particular embodiment, the method according to the invention further comprises, after step $i_0$), and particularly of anodization, the following step:

$i_1$) plugging the pores of said layer of hydrated alumina.

This step $i_1$) makes it possible to improve the compactness of the layer of hydrated alumina. After this step $i_1$), all the pores on the surface of the layer of hydrated alumina are plugged.

Step $i_1$) may be performed for example by carrying out a hot hydration of said elongated electrical conductor element by dipping said elongated electrical conductor element into boiling water or hot water.

The plugging can be carried out in water, possibly with an additive, such as nickel salt at a temperature greater than 80° C., preferably comprised between 90 and 95° C.

Advantageously, said elongated electrical conductor element obtained after step $i_0$) or said elongated electrical conductor element obtained after step $i_1$) is rinsed with reverse osmosis water.

The present invention has as its third object a composite material obtained according to the method in accordance with the second object of the invention.

The composite material obtained according to the method in accordance with the second object of the invention may be a composite material as defined in the first object of the invention.

The present invention also has as its fourth object an electrical cable comprising at least one composite material according to the first object of the invention or obtained according to the method in accordance with the second object of the invention.

Said cable has improved mechanical and electrical properties.

Thus, the composite material is used as an elongated electrical conductor element in said cable.

In one particular embodiment, the composite material may be in the form of a composite strand of round, trapezoidal, or Z-shaped cross section.

In one embodiment, the cable comprises several composite strands, and preferably an assemblage of composite strands.

This assemblage may in particular form at least one layer of continuous envelope type, for example with a circular or oval or indeed square cross section.

According to one particularly preferred embodiment of the invention, the cable may be an OHL cable.

Consequently, it may comprise an elongated reinforcement element, preferably central, said assemblage possibly being positioned around the elongated reinforcement element.

When the composite strands have a round cross section, they may have a diameter which may range from 2.25 mm to 4.75 mm. When the strands have a nonround cross section, their equivalent diameter in round section may likewise range from 2.25 mm to 4.75 mm.

Of course, it is preferable for all the strands constituting an assemblage to have the same shape and the same dimensions.

In one preferred embodiment of the invention, the elongated reinforcement element is surrounded by at least one layer of an assemblage of composite strands.

Preferably, the composite strands constituting at least one layer of an assemblage of composite strands are able to provide said layer with a substantially regular surface, each strand constituting the layer being able to have in particular a cross section of complementary shape to the strand(s) adjacent to it.

According to the invention, by "composite strands able to provide said layer with a substantially regular surface, each strand constituting the layer being able to have in particular a cross section of complementary shape to the strand(s) adjacent to it" is meant that the juxtapositioning or the nesting of all the strands constituting the layer forms a continuous envelope (with no irregularities), for example one of circular or oval or indeed square cross section.

Thus, the strands of Z-shaped or trapezoidal cross section make it possible to obtain a regular envelope, unlike the strands of round cross section. In particular, strands of Z-shaped cross section are preferred.

In an even more preferred manner, said layer formed by the assemblage of the composite strands has a ring-shaped cross section.

The elongated reinforcement element may typically be a composite or metallic element. As an example, mention may be made of strands of steel or composite strands of aluminium in an organic matrix.

The composite strands may be twisted about the elongated reinforcement element, especially when the cable comprises an assemblage of composite strands.

In one particular embodiment, the electrical cable of the invention comprises at least one electrically insulating layer surrounding said composite material or the plurality of composite materials, said electrically insulating layer comprising at least one polymer material.

The polymer material of the electrically insulating layer of the cable of the invention may be chosen from among the cross-linked and the non cross-linked polymers, the polymers of inorganic type and of organic type.

The polymer material of the electrically insulating layer may be a homo- or a co-polymer having thermoplastic and/or elastomeric properties.

The polymers of inorganic type may be polyorganosiloxanes.

The polymers of organic type may be polyolefins, polyurethanes, polyamides, polyesters, polyvinyls or halogenated polymers, such as fluorinated polymers (e.g. polytetrafluoroethylene PTFE) or chlorinated polymers (e.g. polyvinyl chloride, PVC).

The polyolefins may be chosen from among the polymers of ethylene and propylene. As an example of polymers of ethylene, mention may be made of the linear low-density polyethylenes (LLDPE), the low-density polyethylenes (LDPE), the medium-density polyethylenes (MDPE), the high-density polyethylenes (HDPE), the copolymers of ethylene and vinyl acetate (EVA), the copolymers of ethylene and butyl acrylate (EBA), methyl acrylate (EMA) and 2-hexylethyl acrylate (2HEA), the copolymers of ethylene and alpha-olefins such as for example the polyethylene-octenes (PEO), the copolymers of ethylene and propylene (EPR), the copolymers of ethylene/ethyl acrylate (EEA), or the terpolymers of ethylene and propylene (EPT) such as for example the terpolymers of ethylene propylene diene monomer (EPDM).

More particularly, the electrical cable according to the invention may be an electrical cable of the power cable type.

For example, the cable of the invention may comprise a composite material according to the first object of the invention or obtained according to the method according to the second object of the invention, a first semiconductor layer surrounding said composite material, an electrically insulating layer surrounding the first semiconductor layer and a second semiconductor layer surrounding the electrically insulating layer.

The electrically insulating layer is such as defined previously.

In one particular embodiment, generally according to the electrical cable of power cable type of the invention, the first semiconductor layer, the electrically insulating layer, and the second semiconductor layer constitute a three-layer insulation. In other words, the electrically insulating layer is in direct physical contact with the first semiconductor layer, and the second semiconductor layer is in direct physical contact with the electrically insulating layer.

The electrical cable of the invention may further comprise a metallic screen surrounding the second semiconductor layer.

This metallic screen may be a so-called "wireframe" screen, composed of an assembly of conductors made of copper or aluminium, arranged about and along the second semiconductor layer, a so-called "banded" screen composed of one or more metallic conductor bands placed in a spiral around the second semiconductor layer, or a so-called "tight" screen of metallic tubing type, surrounding the second semiconductor layer. This latter type of screen in particular makes it possible to present a barrier to moisture having a tendency to penetrate into the electrical cable in the radial direction.

All the types of metallic screens may play the role of earthing the electrical cable and may thus transport fault currents, for example in event of a short circuit in the particular grid.

Moreover, the cable of the invention may comprise an outer protection sleeve surrounding the second semiconductor layer, or indeed surrounding more particularly said metallic screen, when present. This outer protection sleeve may be realized classically from suitable thermoplastic materials, such as HDPE, MDPE or LLDPE; or indeed from materials retarding flame propagation or resisting flame propagation. In particular, if the latter do not contain halogen, reference is made to a sleeve of type HFFR (Halogen Free Flame Retardant).

Other layers, such as layers which swell in the presence of moisture, may be added between the second semiconductor layer and the metallic screen when present and/or between the metallic screen and the outer sleeve when present, these layers making it possible to ensure the longitudinal watertightness of the electrical cable.

BRIEF DESCRIPTION OF THE DRAWINGS

Other characteristics and advantages of the present invention will appear in light of the following examples with reference to the annotated figures, said examples and figures being given as an illustration and in no way as a limitation.

For reasons of clarity, only the essential elements for the understanding of the invention have been shown in a schematic manner, and without regard to scale.

DETAILED DESCRIPTION

Figure 1:
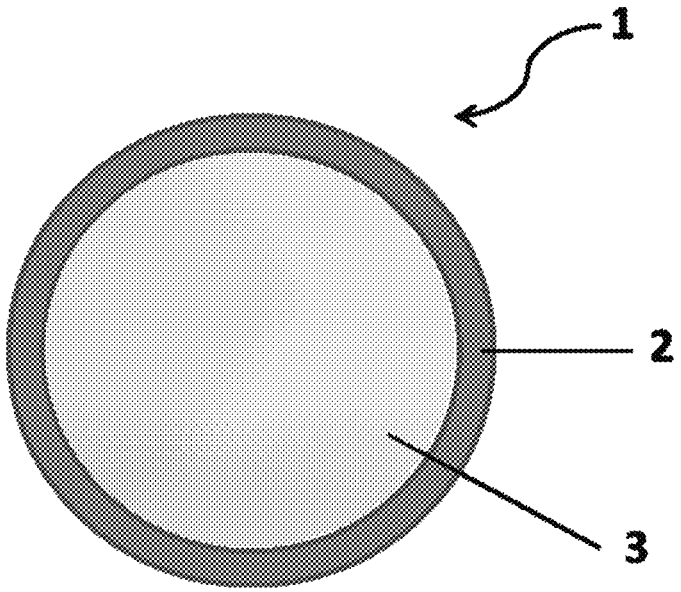
FIG. 1 shows in schematic fashion a structure, in cross section, of a first variant of an electrical cable according to the invention.

FIG. 1 shows a first variant of an electrical cable 1 according to the invention, in cross section view, comprising a composite material 2 according to the first object of the invention or obtained according to the method in accordance with the second object of the invention and an electrically insulating layer 3 surrounding said composite material 2.

Figure 2:
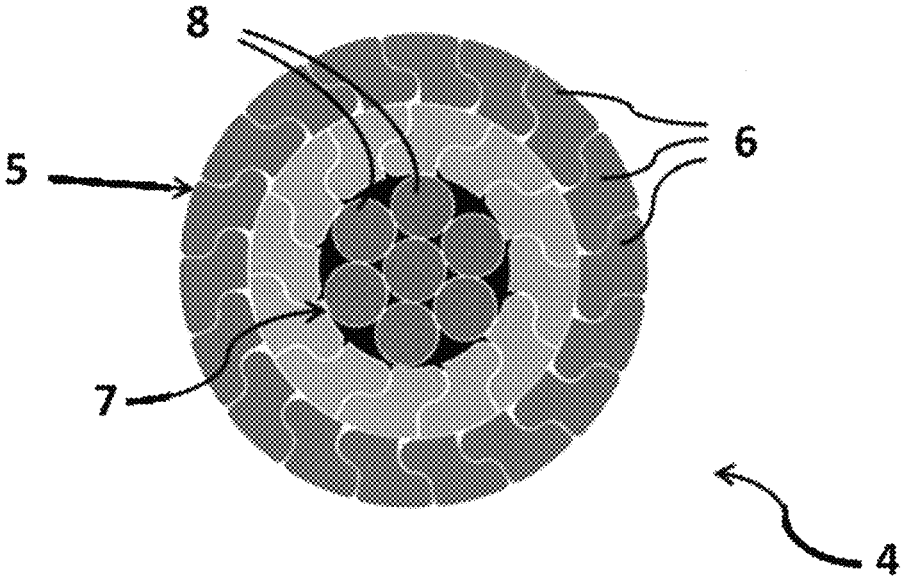
FIG. 2 shows in schematic fashion a structure, in cross section, of a second variant of an electrical cable according to the invention.

FIG. 2 shows a second variant of a high-voltage electrical transmission electrical cable 4 of OHL type according to the invention, in cross section view, comprising three layers of an assemblage 5 of composite strands 6, each composite strand being constituted of a composite material according to the invention. These three layers 5 surround a central elongated reinforcement element 7. The composite strands 6 constituting said layers 5 have a Z-shaped cross section (or S-shaped, depending on the orientation of the Z). The central elongated reinforcement element 7 shown in FIG. 2 may be, for example, steel strands 8 or composite strands of aluminium in an organic matrix.

In the embodiment shown in FIG. 2, it is possible to modify the number of composite strands 6 of each layer 5, their shape, the number of layers 5 or indeed the number of steel strands or composite strands 8.

Figure 3:
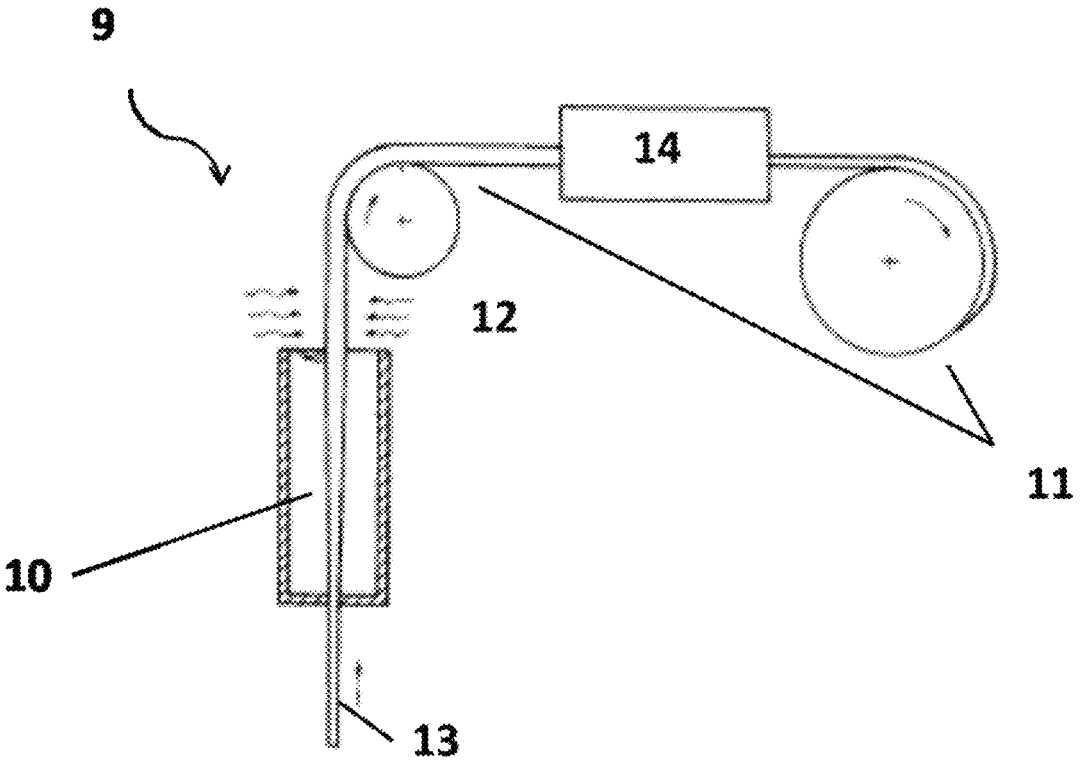
FIG. 3 shows in schematic fashion a variant of a method of manufacture of a composite material according to the invention.

FIG. 3 shows a device 9 which can be used to manufacture a composite material according to the method in accordance with the invention. The device comprises a vat 10 designed to contain a bath of molten aluminium or of a molten aluminium alloy and transport means 11 serving to convey an elongated electrical conductor element comprising a layer of hydrated alumina 13 to said vat 10. At the end of step i), an elongated electrical conductor element of aluminium or of aluminium alloy comprising a layer of hydrated alumina and coated with molten aluminium or a molten aluminium alloy is directly cooled down at the exit from the vat 10, in particular with the aid of cooling means 12, to obtain a solid mass (step ii)). Then the solid mass is taken to rolling means 14 situated after the cooling means 12 in order to carry out step iii).

Preparation of Composite Materials According to the Invention and Obtained in Accordance with the Method According to the Invention An electrical conductor element of aluminium alloy, marketed under the brand Al1370 and comprising a layer of hydrated alumina of thickness around 6 μm, was prepared in the following manner:

Steps a), b), c): for these steps, an electrical conductor element of aluminium alloy Al1370 of diameter 2.97 mm was used. Said elongated electrical conductor element was scoured and degreased by dipping it into a solution of soda and surfactants, known as GARDOCLEAN and marketed by the CHEMETALL company (30-50 g/L of soda), at a temperature of around 40 to around 60° C., for a duration of around 30 seconds. Next, said elongated electrical conductor element was dipped into a solution of sulfuric acid (20% by weight of sulfuric acid in distilled water) to carry out the neutralization step c), at ambient temperature, for 10 seconds.

Step $i_0$): a layer of hydrated alumina of thickness around 6 μm was formed around the electrical conductor element previously obtained by anodization, using a current density of around 60 A/dm$^2$ and a voltage of around 22 V.

Step $i_1$): the pores of the layer of hydrated alumina were plugged.

Step i): four electrical conductor elements such as those previously prepared were placed in contact with a molten aluminium alloy marketed under the brand Al1370 by casting said molten aluminium alloy onto said elongated electrical conductor elements.

To do this, said elongated electrical conductor elements were therefore placed in a cylindrical mould.

Step ii): the mould was cooled in air at around 20° C., to form a solid cylinder of diameter around 37 mm and length around 150 mm.

Step iii): the cylinder was extruded at around 450° C. after having heated the cylinder for around two hours.

Step iv): the composite material obtained in the preceding step iii) was rolled at 20° C. in order to obtain a composite material according to the invention, denoted as $M_1$, or the composite material obtained in the preceding step iii) was wire-drawn to form a wire-drawn composite material $M_2$.

Step v): the rolled composite material $M_1$ obtained in step iv) was annealed at 350° C. for 2 h to form a composite material $M_3$ or the wire-drawn composite material $M_2$ obtained in step iv) was annealed at 350° C. for 2 h to form a composite material $M_4$.

For comparison, the steps as described above were reproduced with an electrical conductor element of aluminium alloy marketed under the brand Al1370 and not comprising a layer of hydrated alumina (i.e. not according to the invention) to form respectively the non composite materials $M'_1$, $M'_2$, $M_3$ and $M'_4$.

Table 1 below illustrates the electrical conductivity (in % IACS), mechanical tensile strength (in MPa) and elongation at breaking (in %) results of the composite materials $M_1$, $M_2$, $M_3$ and $M_4$ of the invention and for comparison of the materials not comprising alumina (i.e. not according to the invention) $M'_1$, $M'_2$, $M_3$ and $M'_4$.

TABLE 1

| | Conductivity % IACS | Mechanical tensile strength (in MPa) | Elongation at breaking (in %) |
|---|---|---|---|
| $M_1$ | 59.6 | 187 | 2 |
| $M'_1$ | 62.8 | 132 | 2 |
| $M_2$ | 58.7 | 194 | 2 |
| $M'_2$ | 62.9 | 138 | 2 |
| $M_3$ | 61.3 | 96 | 19 |
| $M'_3$ | — | 57 | 30 |
| $M_4$ | 60.7 | 100 | 24 |
| $M'_4$ | 63.4 | 73 | 39 |

The composite material of the invention therefore has an improved mechanical strength while guaranteeing a good electrical conductivity so as to be able to be used as an elongated electrical conductor element of an electrical and/or a telecommunications cable.

Figure 4:
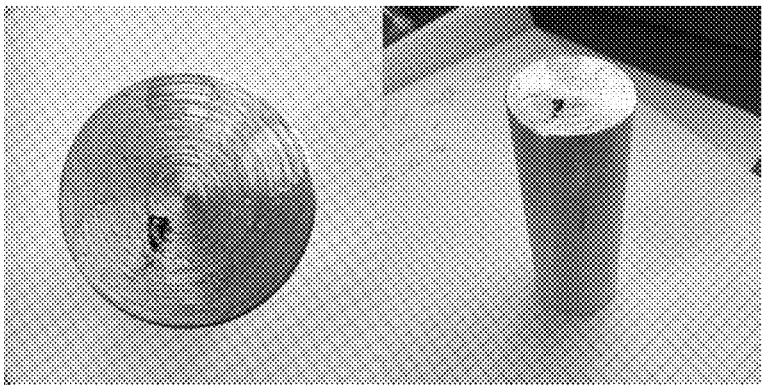
FIG. 4 shows two images of a composite material obtained at the end of step ii) according to the method of the invention.
Figure 5:
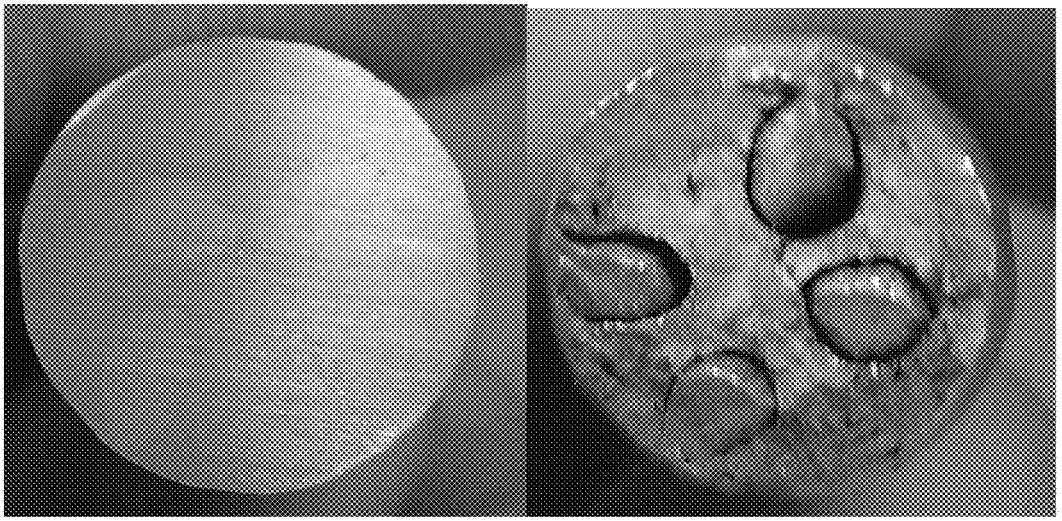
FIG. 5 shows an image and a cross section of a composite material according to the invention obtained at the end of step iii) according to the method of the invention.
Figure 6:
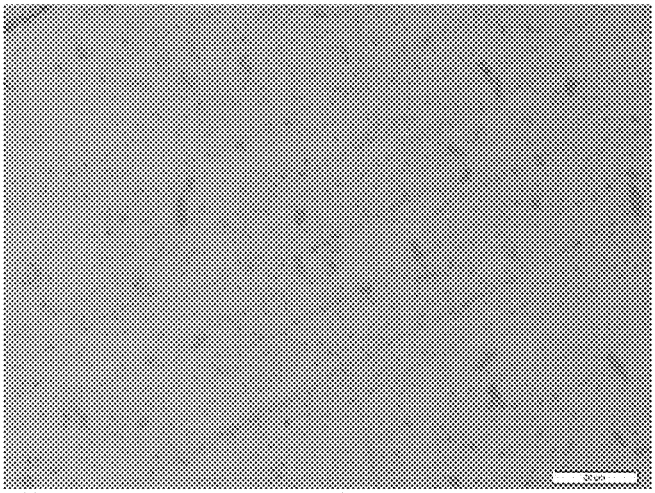
FIG. 6 shows the interior of a composite material according to the invention obtained at the end of step iii) according to the method of the invention.

FIG. 4 shows two photos of the composite material prior to the extrusion step iii) and FIG. 5 shows two photos of the composite material obtained after the extrusion step iii). FIG. 6 shows the dispersion of the particles of alumina (in grey) within the matrix of aluminium alloy.

The invention claimed is:

1. A method for preparation of a composite material having a matrix of aluminum or aluminum alloy and particles of alumina dispersed in said matrix of aluminum or aluminum alloy, wherein said method comprises at least the following steps:

i) placing in contact at least one elongated electrical conductor element of aluminum or of aluminum alloy comprising a layer of hydrated alumina with molten aluminum or a molten aluminum alloy, ii) forming a solid mass based on alumina and aluminum, and iii) breaking the layer of hydrated alumina inside the solid mass, in order to form a composite material comprising a matrix of aluminum or aluminum alloy and particles of alumina dispersed in said matrix of aluminum or aluminum alloy.

2. The method according to claim 1, wherein the layer of hydrated alumina has a thickness ranging from 4 to 20 p.m.

3. Method according to claim 1, wherein step i) is carried out by any one of the following methods:

casting molten aluminum or a molten aluminum alloy onto said elongated electrical conductor element of aluminum or of aluminum alloy comprising a layer of hydrated alumina, or passing said elongated electrical conductor element of aluminum or of aluminum alloy comprising a layer of hydrated alumina continuously through a bath of molten aluminum or of a molten aluminum alloy.

4. The method according to claim 1, wherein step i) is carried out by casting molten aluminum or a molten aluminum alloy onto said at least one elongated electrical conductor element of aluminum or of aluminum alloy comprising a layer of hydrated alumina placed in a container and step iii) is an extrusion step.

5. The method according to claim 1, wherein step i) is carried out by continuous passing of said at least one elongated electrical conductor element of aluminum or of aluminum alloy comprising a layer of hydrated alumina through a bath of molten aluminum or of a molten aluminum alloy or by continuous casting of molten aluminum or a molten aluminum alloy onto at least one elongated electrical conductor element of aluminum or of aluminum alloy comprising a layer of hydrated alumina placed on a casting wheel, and step iii) is a rolling step.

6. Method according to claim 1, wherein said method further comprises a step iv) of shaping the composite material obtained in the preceding step iii) in order to obtain a composite material having the desired dimensions and shape.

7. The method according to claim 1, wherein said method further comprises, after step iii) or step iv), a heating step v).

8. The method according to claim 1, wherein said method furthermore comprises, prior to step i), a step $i_0$) of formation of the layer of hydrated alumina by anodization.

9. The electrical cable, wherein said electrical cable comprises at least one composite material obtained according to the method of claim 1, said composite material having a matrix of aluminum or aluminum alloy and particles of alumina dispersed in said matrix of aluminum or aluminum alloy.

10. The electrical cable according to claim 9, wherein said cable is an OHL cable comprising an elongated reinforcement element and an assemblage of composite strands positioned around the elongated reinforcement element, each of the composite strands being said composite material.

11. The electrical cable according to claim 9, wherein said cable comprises at least one electrically insulating layer surrounding said composite material or the plurality of composite materials, said electrically insulating layer comprising at least one polymer material.

12. The electrical cable according to claim 9, wherein said composite material comprises from 1 to 10,000 ppm of alumina.

13. The electrical cable according to claim 9, wherein said composite material has an electrical conductivity of at least 45% IACS.

14. The electrical cable according to claim 9, wherein said composite material has a mechanical tensile strength ranging from 70 to 500 MPa.

15. The electrical cable according to claim 9, wherein the particles of alumina have a thickness of at least 0.1 μm.

16. The electrical cable according to claim 9, wherein the particles of alumina have a mean size ranging from 0.5 to 10 μm.

17. The electrical cable according to claim 9, wherein said composite material is a nonporous material.

* * * * *